US009714562B2

(12) United States Patent
Yeboah et al.

(10) Patent No.: US 9,714,562 B2
(45) Date of Patent: Jul. 25, 2017

(54) DOWNHOLE LOGGING COMMUNICATION MODULE

(71) Applicant: SCHLUMBERGER TECHNOLOGY CORPORATION, Sugar Land, TX (US)

(72) Inventors: Jonathan Yeboah, Sugar Land, TX (US); Sebastine Ujereh, Houston, TX (US); Emil Steve Macha, Sugar Land, TX (US); Laurent Villegas, Houston, TX (US); Christopher S. Del Campo, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/004,295

(22) Filed: Jan. 22, 2016

(65) Prior Publication Data

US 2017/0114629 A1 Apr. 27, 2017

Related U.S. Application Data

(63) Continuation-in-part of application No. 13/505,146, filed as application No. PCT/US2010/037232 on Jun.
(Continued)

(51) Int. Cl.
*G01V 3/00* (2006.01)
*E21B 47/01* (2012.01)
*E21B 47/12* (2012.01)

(52) U.S. Cl.
CPC ..... *E21B 47/011* (2013.01); *E21B 47/124* (2013.01)

(58) Field of Classification Search
CPC ..... E21B 47/011; E21B 47/124
See application file for complete search history.

(56) References Cited

U.S. PATENT DOCUMENTS 4,928,083 A 5/1990 Sims, Jr. et al.
4,928,088 A 5/1990 Jorion et al.
(Continued)

FOREIGN PATENT DOCUMENTS

EP 2496974 A1 9/2012
MX 2012005188 A 6/2012
(Continued)

OTHER PUBLICATIONS

Office Action issued in the related RU application 2012123395, dated Aug. 8, 2013 (5 pages).
(Continued)

*Primary Examiner* — Erin File
(74) *Attorney, Agent, or Firm* — Michael Dae

(57) ABSTRACT

A downhole communications module for connecting with a string of downhole logging tools includes an optical annunciator and a communications port deployed in corresponding apertures in a tool body. The aperture housing the annunciator is sealed by a port plug having an optically transparent window. The aperture housing the communications port is sealed by a removable plug. A controller is deployed in the tool body and includes a memory module in electronic communication with the communications port. The controller is further configured to control operation of the annunciator.

13 Claims, 9 Drawing Sheets

Related U.S. Application Data

3, 2010, now abandoned, application No. 15/004,295, which is a continuation-in-part of application No. 13/505,053, filed as application No. PCT/US2010/037224 on Jun. 3, 2010, now abandoned.

(60) Provisional application No. 61/258,660, filed on Nov. 6, 2009, provisional application No. 61/258,656, filed on Nov. 6, 2009.

(56) References Cited

U.S. PATENT DOCUMENTS

| | | | | |
|---|---|---|---|---|
| 5,363,095 | A | 11/1994 | Normann et al. | |
| 6,041,857 | A * | 3/2000 | Carmody | E21B 34/066 166/324 |
| 6,555,958 | B1 | 4/2003 | Srivastava et al. | |
| 7,154,838 | B2 | 12/2006 | Kamei et al. | |
| 7,281,324 | B2 | 10/2007 | Kent et al. | |
| 2002/0030400 | A1 | 3/2002 | Frederick et al. | |
| 2003/0218547 | A1 | 11/2003 | Smits et al. | |
| 2004/0051650 | A1 | 3/2004 | Gonsoulin et al. | |
| 2005/0152219 | A1 * | 7/2005 | Garcia-Osuna | G01V 1/52 367/25 |
| 2006/0065395 | A1 | 3/2006 | Snell | |
| 2006/0288769 | A1 | 12/2006 | Odom | |
| 2007/0168132 | A1 * | 7/2007 | Yu | E21B 47/12 702/6 |
| 2007/0260734 | A1 | 11/2007 | Hsu et al. | |
| 2008/0001775 | A1 | 1/2008 | Wiese et al. | |
| 2009/0025926 | A1 * | 1/2009 | Briquet | E21B 49/10 166/105 |
| 2009/0107667 | A1 | 4/2009 | Mullins et al. | |
| 2009/0141273 | A1 | 6/2009 | Poulter et al. | |
| 2009/0311915 | A1 | 12/2009 | Stiehl | |
| 2010/0188227 | A1 | 7/2010 | Yang | |
| 2011/0044697 | A1 | 2/2011 | Peter et al. | |
| 2013/0099935 | A1 | 4/2013 | Ujereh et al. | |
| 2013/0335092 | A1 * | 12/2013 | Wu | G01V 3/28 324/333 |
| 2014/0041876 | A1 * | 2/2014 | Fleckenstein | E21B 34/08 166/306 |
| 2016/0084013 | A1 * | 3/2016 | Hradecky | E21B 41/00 166/380 |

FOREIGN PATENT DOCUMENTS

| | | | |
|---|---|---|---|
| RU | 1715 | U1 | 2/1996 |
| RU | 2149994 | C1 | 5/2000 |
| RU | 2552249 | C2 | 12/2013 |
| WO | 2007085935 | A1 | 8/2007 |
| WO | 2011056263 | A1 | 5/2011 |

OTHER PUBLICATIONS

Decision of Grant issued in the related RU application 2012123395, dated Mar. 24, 2014 (8 pages).
International Search Report and the Written Opinion issued in the related PCT application PCT/US2010/037224 dated Feb. 28, 2011 (7 pages).
International Preliminary Report on Patentability issued in the related PCT application PCT/US200/037224 dated May 8, 2012 (3 pages).
Office Action issued in the related CA application 2780099, dated Feb. 16, 2016 (3 pages).
Office Action issued in the related MX application MX/a/2012/005188, dated May 29, 2013 (7 pages).
Office Action issued in the related RU application 2012123378, dated Dec. 11, 2013 (6 pages).
Decision of Grant issued in the related RU application 2012123378, dated Mar. 16, 2015 (8 pages).
International Search Report and the Written Opinion issued in the related PCT application PCT/US2010/037232 dated Nov. 30, 2010 (7 pages).
International Preliminary Report on Patentability issued in the related PCT application PCT/US2010/037232 dated May 8, 2012 (6 pages).
Examination Report issued in related CA application 2780068 on May 10, 2016, 3 pages.

* cited by examiner

DOWNHOLE LOGGING COMMUNICATION MODULE

CROSS REFERENCE TO RELATED APPLICATIONS

This application is a continuation-in-part of co-pending, commonly-invented, and commonly-assigned U.S. patent application Ser. No. 13/505,146 entitled Light Based Communication Port For Use On Downhole Tools, which is a national stage entry of PCT/US10/37232, which claims priority from U.S. Provisional Application 61/258,660, filed on Nov. 6, 2009. This application is also a continuation in part of U.S. patent application Ser. No. 13/505,053 entitled Communication Port for use on a Wellbore Measuring Instrument, which is a national stage entry of PCT/US10/37224, which claims priority from U.S. Provisional Application 61/258,656, filed on Nov. 6, 2009.

FIELD OF THE INVENTION

Disclosed embodiments relate generally to downhole wireline logging tools and more particularly to a communication module for digitally communicating with a string of wireline logging tools.

BACKGROUND INFORMATION

Many types of wellbore measurement instruments are known in the art. Such instruments generally include an elongated, pressure resistant housing configured to move through a wellbore drilled through subsurface rock formations. The housing generally includes one or more sensors that measure selected parameters in the wellbore. The parameters, without limitation, include those related to the physical properties of the wellbore itself (e.g., temperature, pressure, fluid content, wellbore geodetic trajectory); construction of the wellbore (e.g., torque and/or axial force applied to a drill bit) and the formations surrounding the wellbore (e.g., resistivity, acoustic velocity, neutron interactive properties, density, and pore fluid pressure and composition).

The housing may be configured to be moved through the wellbore using several different techniques known in the art, including, without limitation, within a drill string or other jointed pipe string, on coiled tubing, or on armored electrical cable or slickline.

Irrespective of the conveyance device used, and irrespective of the types of sensor(s) used in any particular wellbore measurement instrument, such instruments typically include some form of data storage device therein and/or a controller that may be reprogrammed so that measurement and/or data storage and communication functions of the instrument may be changed to suit a particular purpose. Access to the data storage and/or access to the instrument controller typically requires electrical connection to a suitable communications port in the instrument, particularly for those instruments designed to be conveyed other than on an armored electrical cable. Communication ports known in the art include electrical connectors that are designed specifically for the particular instrument. More specifically, the arrangement of electrical contacts in the particular connector is typically unique to the type of instrument. Such arrangement of electrical contacts also requires that an electrical cable used to connect the communication port to a surface device (such as a computer or other data processor) must also be specially made to engage the electrical contacts on the communication port connector. Such specialized communication port connectors and corresponding cables can be expensive to manufacture, and may create logistical difficulties in the event of cable failure, e.g., timely obtaining a replacement.

Additionally, the necessity of a cable reduces the ease and speed with which the communication can take place. Finally the communication is impossible without a PC or similar surface device, adding complexity and more cost to the process. A sonic device (buzzer) is another instrument known in the art used to relay information between the measuring instrument and the instrument's human operator. The method used with the buzzer is to communicate with the tool operator through a series of high volume "beeps" of selected timing and duration. This technique is limited due to the difficulty in hearing on an average rig floor which has a number of very high volume sound sources. Not only does external noise interfere, but sound penetration through the typical housing of downhole tools is limited. Lastly, the range of information that can be transferred is minimal when dealing with sound communication in an uncontrolled environment.

What is needed is a more reliable device for communicating certain instrument signals to the instrument operator and/or to a surface device.

SUMMARY

A downhole communications module for connecting with a string of downhole logging tools is disclosed. The communications module includes a downhole tool body configured to be connected with a string of wireline logging tools. A light emitting diode annunciator is deployed in a first aperture in the tool body, the first aperture sealed by a port plug having an optically transparent window therein. The port plug is configured to resist entry of wellbore fluid into an interior of the tool body. A communications port includes an electrical connector disposed in a second aperture in the tool body. The second aperture further includes a removable plug for sealing the communications port and resisting entry of wellbore fluid into the interior of the tool body. A controller is deployed in the tool body and includes a memory module in electronic communication with the communications port. The controller is further configured to control operation of the annunciator. Methods for using the communications module are also disclosed.

The disclosed embodiments may provide various technical advantages. For example, the communications module is configured to enable a wireline logging operation to proceed without a wireline connection to the surface. As such, the communications module may obviate the need for using a dedicated wireline logging truck and may therefore significantly reduce the cost of the logging operation. The communications module is further configured to provide quick visual indication of the status of each of the wireline tools in the logging string. Moreover, a communications port is configured to provide quick and easy electronic access to data stored in tool memory. A power management circuit advantageously enables the tool memory to be powered by substantially any electronic device coupled with the communications port.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
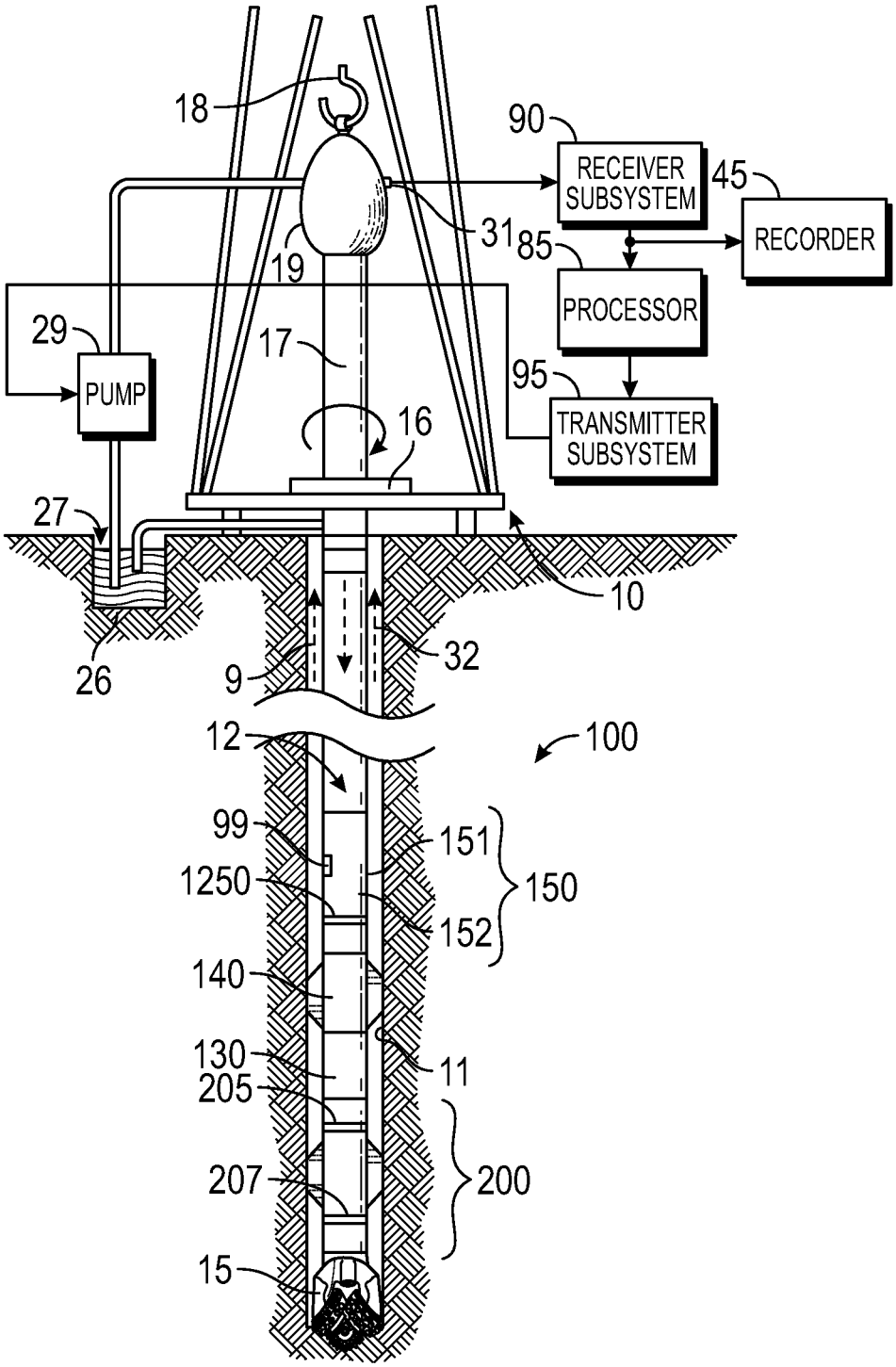
FIG. 1 shows an example MWD/LWD wellbore measurement instrument system operating in a wellbore.

Referring to FIG. 1, there is illustrated an example wellbore measurement instrument that can be used with the invention. The instrument in the present example is in the form of a measuring-while-drilling apparatus. As used herein, "wellbore measurement instrument" is intended to mean any instrument configured to move along the interior of a wellbore and make measurements of at least one parameter related to the wellbore, the formations surrounding the wellbore or the dynamics of a conveyance device used to move the instrument along the wellbore.

The example manner of instrument conveyance shown in FIG. 1 is known as measurement-while-drilling, also called measuring-while-drilling or logging-while-drilling and is intended to include the taking of measurements in a wellbore near the end of a jointed pipe assembly. Such pipe assembly typically includes a drill bit and at least some of the drill string (the jointed pipe assembly) being disposed in the wellbore during drilling, pausing, and/or tripping. It is to be clearly understood that the example shown in FIG. 1 is intended only to serve as an example of wellbore measurement instruments and modes of instrument conveyance that may be used in accordance with the invention. Other modes of instrument conveyance include, without limitation, by any other form of segmented (jointed) pipe, coiled tubing, wireline, slickline, hydraulic pumping and wellbore tractors. Accordingly, the invention is not limited to use with while-drilling instrumentation as shown in FIG. 1.

In the example of FIG. 1, a platform and derrick 10 are positioned over a borehole 11 that is formed in the subsurface rock formations by rotary drilling. A drill string 12 is suspended within the borehole and includes a drill bit 15 at its lower end. The drill string 12 and the drill bit 15 attached thereto are rotated by a rotating table 16 (energized by means not shown) which engages a kelly 17 at the upper end of the drill string. The drill string 12 is suspended from a hook 18 attached to a travelling block (not shown). The kelly 17 is connected to the hook through a rotary swivel 19 which permits rotation of the drill string 12 relative to the hook. Alternatively, the drill string 12 and drill bit 15 may be rotated from the surface by a "top drive" (not shown) type of drilling rig. Drilling fluid or mud 26 is contained in a tank or pit 27. A pump 29 pumps the drilling fluid into the drill string 12 via a port in the swivel 19 to flow downward (arrow 9) through the center of drill string 12. The drilling fluid exits the drill string 12 via courses or nozzles (not shown) in the drill bit 15 and then circulates upward in the annular space between the outside of the drill string 12 and the wall of the wellbore, commonly referred to as the "annulus", as indicated by the flow arrows 32. The drilling fluid lubricates and cools the bit 15 and carries formation cuttings to the surface. The drilling fluid is returned to the pit 27 for recirculation. An optional directional drilling assembly (not shown) with a mud motor having a bent housing or an offset sub could also be used. It is also known in the art to use a "straight housing" mud driven motor to turn the bit either alone or in combination with rotational energy supplied from the surface (kelly 17 or top drive [not shown]).

Mounted within the drill string 12, preferably near the drill bit 15, is a bottom hole assembly, generally referred to by reference numeral 100, which includes capabilities for measuring, processing, and storing information, and communicating with a recording unit 45 at the earth's surface. As used herein, "near" the drill bit 15 generally means within several drill collar lengths from the drill bit. The bottom hole assembly 100 includes a measuring and local communications apparatus 200 which is described further below. The local communications apparatus may accept as input signals from one or more sensors 205, 207 which may measure any "wellbore parameter" as described above.

In the example of the illustrated bottom hole assembly 100, a drill collar 130 and a stabilizer collar 140 are shown successively above the local communications apparatus 200. The collar 130 may be, for example, a "pony" (shorter than the standard 30 foot length) collar or a collar housing for a measuring apparatus which performs measurement functions. The need for or desirability of a stabilizer collar such as 140 will depend on drilling parameters. Located above stabilizer collar 140 is a surface/local communications subassembly 150. The communications subassembly 150 in the present example may include a toroidal antenna 1250 used for local communication with the local communications apparatus 200, and a known type of acoustic communication system that communicates with a similar system at the earth's surface via signals carried in the drilling fluid or mud. The to-surface communication system in subassembly 150 includes an acoustic transmitter which generates an acoustic signal in the drilling fluid that is typically representative of one or more measured downhole parameters. One suitable type of acoustic transmitter employs a device known as a "mud siren" which includes a slotted stator and a slotted rotor that rotates and repeatedly interrupts the flow of drilling fluid to establish a desired acoustic wave signal in the drilling fluid. Electronics (not shown separately) in the communications subassembly 150 may include a suitable modulator, such as a phase shift keying (PSK) modulator, which conventionally produces driving signals for application to the mud transmitter. These driving signals can be used to apply appropriate modulation to the mud siren. The generated acoustic mud wave travels upward in the fluid through the center of the drill string at the speed of sound in the fluid. The acoustic wave is received at the surface of the earth by transducers represented by reference numeral 31. The transducers, which are, for example, piezoelectric transducers, convert the received acoustic signals to electronic signals. The output of the transducers 31 is coupled to the surface receiving subsystem 90 which is operative to demodulate the transmitted signals, which can then be coupled to processor 85 and the recording unit 45. A surface transmitting subsystem 95 may also be provided, and can control interruption of the operation of pump 29 in a manner which is detectable by transducers (represented at 99) in the communication subassembly 150, so that there can be two way communication between the subassembly 150 and the surface equipment when the wellbore measurement instrument is disposed in the wellbore. In such systems, surface to wellbore communication may be provided, e.g., by cycling the pump(s) 29 on and off in a predetermined pattern, and sensing this condition downhole at the transducers 99. The foregoing or other technique of surface-to-downhole communication can be utilized in conjunction with the features disclosed herein. The communication subsystem 150 may also conventionally include (not show separately for clarity of the illustration) acquisition, control and processor electronics comprising a microprocessor system (with associated memory, clock and timing circuitry, and interface circuitry) capable of storing data from one or more sensors, processing the data and storing the processed data (and/or unprocessed sensor data), and coupling any selected portion of the information it contains to the transmitter control and driving electronics for transmission to the surface. A battery (not shown) may provide electrical power for the communications subassembly 150. As is known in the art, a downhole generator (not shown) such as a so-called "mud turbine" powered by the drilling fluid, can also be used to provide power, for immediate use or battery recharging, during times when the drilling fluid is moving through the drill string 12. It will be understood that alternative acoustic or other techniques can be employed for communication with the surface of the earth. As will be explained in more detail below, communication with the microprocessor system in the communications subassembly 150 when the instrument is at the surface is an element of one embodiment.

The communications subassembly 150 may have a first communications port 151 in the wall of the part of the drill string 12 including the communications subassembly 150 for such purpose to be explained in more detail below. The communications subassembly may also include, in some examples, a second communications port 152 to be used for such purpose as will be more fully explained below.

In other examples of a wellbore measurement instrument that are conveyed other than as part of a drill string (see the examples described above), the instrument housing (e.g., wall of part of the drill string 12) may include a second, similarly configured communications port through the wall thereof.

Figure 2A:
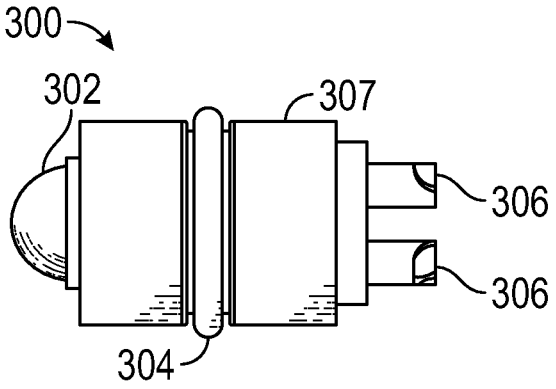
FIGS. 2A and 2B show a side and back end view, respectively, of an example communication light source or photodetector.
Figure 2B:
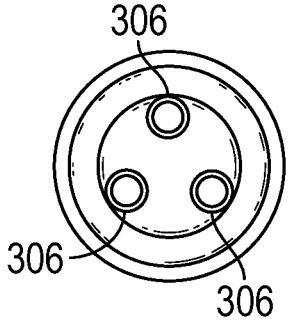

FIGS. 2A and 2B show one example of an optical communication device 300. The device may include an electrically operated light source 302. The electrically operated light source may be, for example, a light emitting diode (LED) or other type of electrically activated source of light. The light source 302 may in some examples emit visible light, such that the instrument operator may observe operation of the light source 302. Visual observation of the light source 302 may enable the operator to determine, for example, instrument operating status, or to observe any data or control signals stored in the instrument susceptible to operator observation and interpretation. The light source 302 may include multiple colors, e.g., red, blue and green, to enable more types of information to be interpretable by the instrument operator. The light source 302 in other examples may emit infrared or other non-visible light to transmit information from the instrument to a surface device, such as the recording unit 45 or a computer as will be further explained below with reference to FIG. 5.

Figure 3:
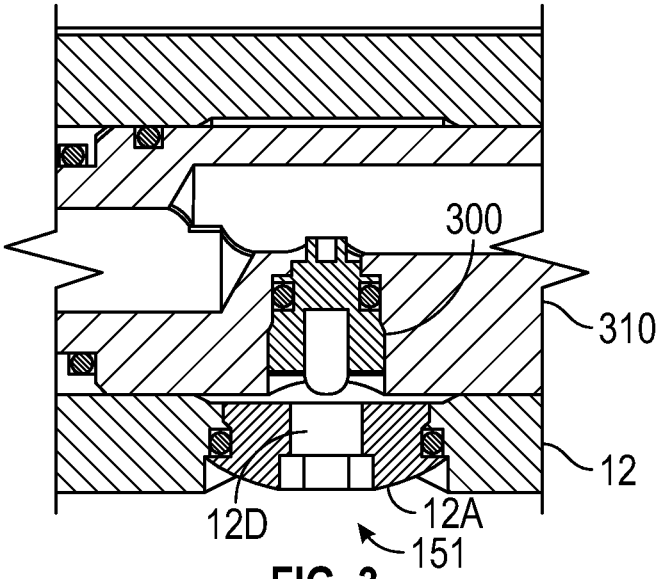
FIG. 3 shows the example light source or photodetector in a port through the housing wall of the measuring instrument.

The light source 302 may be molded or otherwise formed into a casing 307. The casing 307 should be made from a material that is electrically non-conductive and is at least impermeable to moisture, and may in some cases be resistant to pressure so as to exclude entry of wellbore fluid into the interior of the instrument in the event of failure of a port plug (FIG. 3). The casing 307 may include provision for an o-ring 304 or similar seal which sealingly engages the wall of the port (151 in FIG. 1). The light source 302 will typically include two or more electrical contacts 306 which may be connected to suitable circuits in the measuring instrument (e.g., in the communication subassembly 150 in FIG. 1). The electrical contacts 306 are shown more clearly in FIG. 2B.

Figure 4A:
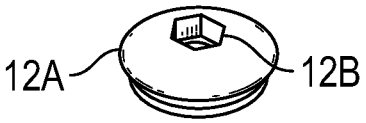
FIGS. 4A through 4D show various views of a port plug used to close the port in which either the photodetector or the light source is located.
Figure 4B:
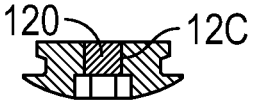
Figure 4C:
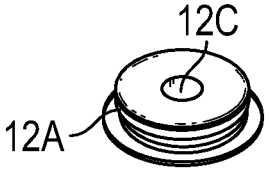
Figure 4D:
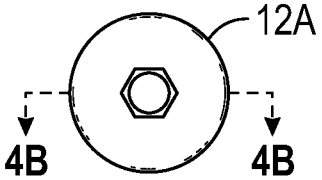

FIG. 3 shows the optical communication 300 device of FIG. 2 disposed in the port 151 in the wall of the instrument. The optical communication device 300 may extend through the port 151 into a circuit chassis 310 of the instrument. The port 151 may be sealingly closed with a port plug 12A. The port plug 12A has an optically transparent window 12D made of material such as boron glass, boron silicate glass or certain types of plastic such that wellbore fluids are excluded from entering the port 151. Various views of the port plug 12A and the optically transparent window 12D are shown in FIGS. 4A through 4D. FIG. 4C in particular shows the window 12D disposed in a suitably shaped opening 12C in the plug 12A. The part of the plug opening 12C external to the window 12D may include a hex or similar configuration (e.g., 12B in FIG. 4A can enable a tool (not shown) to engage the plug 12A for tightening in the port (151 in FIG. 3)).

In another example, wherein a second optical communications port (152 in FIG. 1) is included in the wellbore measuring instrument (e.g., in 150 in FIG. 1), a second optical communication device may be included in such port. The second optical communication device may have substantially the same structure as shown in FIGS. 2A, 2B, 3 and 4A-4D, with the difference being that the light source (302 in FIG. 2A) is substituted by a photodetector (302A in FIG. 5). Having both a light source and a photodetector may enable bidirectional optical communication with the measuring instrument.

Figure 5:
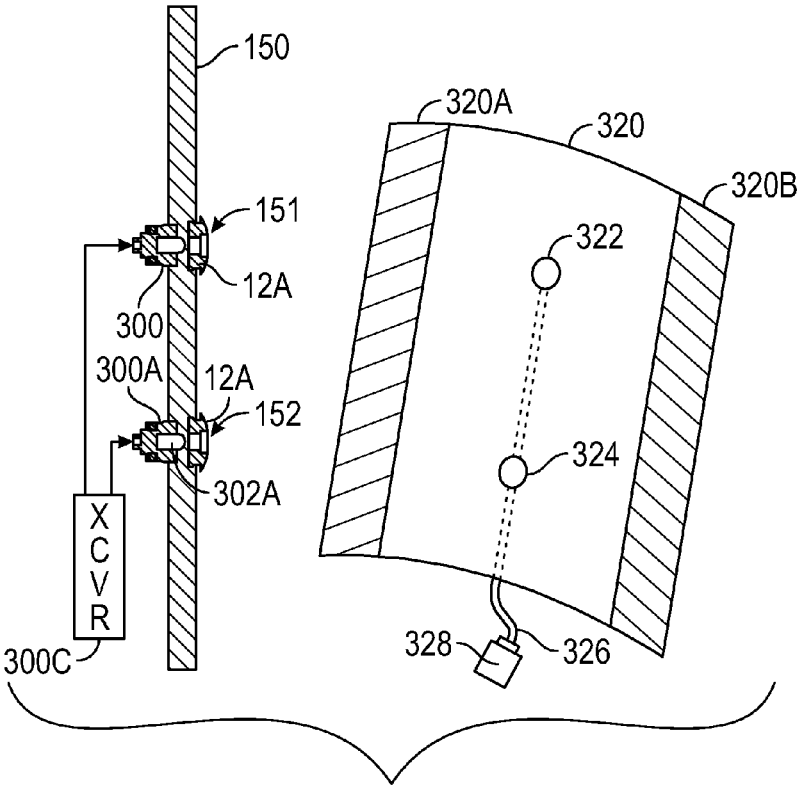
FIG. 5 shows an example communication cable and attachment fixture for the wellbore measurement instrument.

An example of the measuring instrument including bidirectional communication capability is shown in FIG. 5. The instrument, e.g., in the communications subsystem 150 may include first 151 and second 152 communication ports as explained above. The first port 151 may include the light source 300 as explained above. The second port 152 may include a photodetector 300A consisting of a photosensitive element 302A disposed in a structure (casing, o-ring, etc.) substantially as explained with reference to the light source in FIGS. 2A, 2B, 3 and 4A-4D. Because the port plugs 12A each include an optically transparent window (12C in FIG. 4C), it is possible to communicate with the instrument without the need to remove the plugs 12A. Such capability may reduce the amount of maintenance required, or may reduce the incidence of seal failure by reducing the number of insertion and removal operations for the port plugs 12A. An example communication coupling is also shown in FIG. 5. The communication coupling 320 may include, for example, optically opaque fabric or plastic which may be wrapped around the instrument housing (e.g., drill collar section 12 in FIG. 1). Locking devices 320A, 320B, may be located at the ends of the fabric or plastic, for example fabric loop and hook fasteners made from material sold under the trademark VELCRO, which is a registered trademark of Velcro Industries, B.V., a Netherlands corporation. Any other device which may secure the communication coupling to the instrument housing may also be used. The communications coupling includes therein a photodetector 322 and an electrically operated light source 324 (e.g., an LED) that are disposed proximate the respective first 151 and second 152 optical communications ports when the communication coupling is affixed to the instrument housing. Electrical connections to the respective photodetector 322 and light source 324 may be made through a suitable cable 326. The cable 326 may be terminated in an industry standard connector 328 for connection to a surface device such as a computer, or may be terminated in a proprietary or other connection for electrical connection to the recording unit (45 in FIG. 1) when the instrument is at the Earth's surface.

Using the communication coupling 320 as shown in FIG. 5 may enable the instrument, through an internal transceiver 300C (which may be a separate device or may be part of the instrument controller described above) to communicate data stored in a data storage device in the instrument and to receive reprogramming instructions or other data from the surface device (e.g., computer or the recording system 45 in FIG. 1). The type of signals optically communicated between the surface device and the instrument is not intended to limit the scope of the present invention.

Figure 6A:
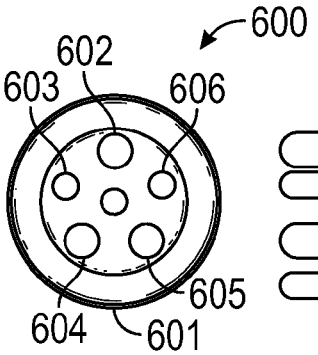
FIG. 6A (Prior Art)
FIGS. 6A, 6B and 6C show various views of a prior art proprietary design communication connector.
Figure 6B:
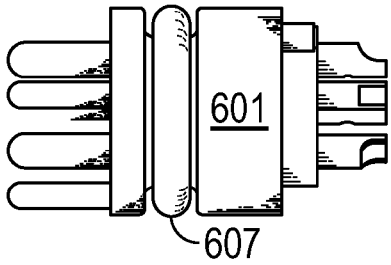
FIG. 6B (Prior Art)
Figure 6C:
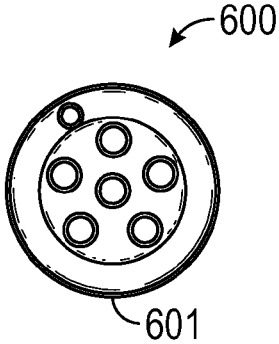
FIG. 6C (Prior Art)

With reference to FIGS. 6A, 6B and 6C, electrical signal communication to the wellbore measurement instrument, when the instrument is removed from the wellbore and is disposed at the surface, is typically performed by connecting an electrical cable to a connector disposed inside the communications port (151 in FIG. 1). Electrical connections known in the art include a specially built connector, having a proprietary electrical contact arrangement. FIG. 6A shows an end view of a typical prior art electrical connector 600, which includes electrical contacts 602, 603, 604, 605, 606 arranged in a proprietary pattern and formed into a casing 601 made from impermeable, electrically insulating material. FIG. 6B shows the connector 600 in side view, wherein the casing 601 may include provision for an o-ring 607 or similar seal. The opposed end view (which is inside the housing when the connector is assembled to the instrument) of the connector 600 is shown in FIG. 6C. The connector 600 in FIGS. 6A, 6B and 6C is typically configured to withstand the maximum expected hydrostatic pressure of fluid in the wellbore to prevent leakage of wellbore fluid into the interior of the wellbore measurement instrument if the exterior of the connector 600 becomes exposed to the wellbore fluid. Such connectors are known as "feedthrough bulkhead" connectors.

Figure 7:
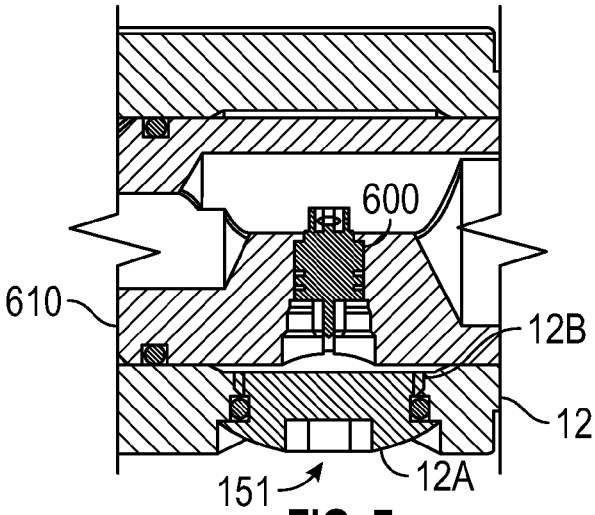
FIG. 7 (Prior Art)
FIG. 7 shows the prior art proprietary design electrical feedthrough communication connector of FIG. 1 disposed in a tool port.

FIG. 7 shows a cross section of the prior art connector 600 assembled to the wellbore measurement instrument. The communications port 151 is formed by creating a suitable aperture 12B in the wall of the appropriate part of the drill string 12 (e.g., one of the collar sections such as the one which houses the communication system 150 in FIG. 1). The connector 600 is disposed in a suitable opening in an internal instrument chassis 610. The drill string aperture 12B may be sealed by a suitable plug 12A.

Figure 8:
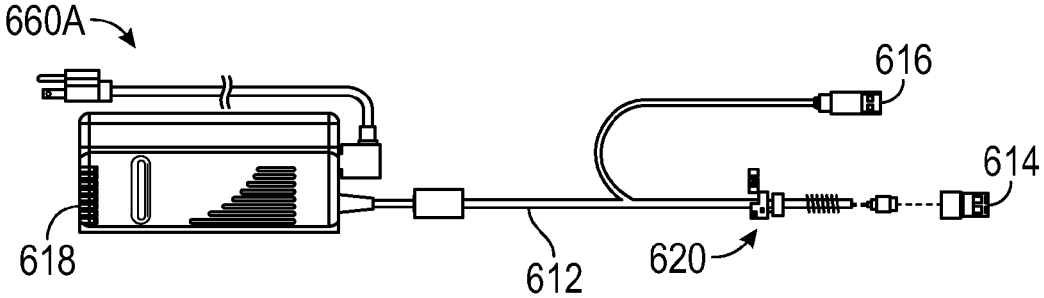
FIG. 8 (Prior Art)
FIG. 8 shows a prior art cable and power supply used with the connector and communication port of FIGS. 6A, 6B, 6C and 7 to connect the communications port to a surface device.

FIG. 8 shows a typical communications cable system 600A that may be used with the prior art communication port and connector (600 in FIGS. 6A, 6B, 6C) explained above to provide signal communication between the wellbore measurement instrument and a surface device, which may acquire the data in storage in the instrument, or may communicate control signals to the instrument, such as a computer (not shown). The surface device may also be a computer (not shown separately) forming part of the recording unit (45 in FIG. 1). The cable system 600A may include a power supply 618 that converts conventional operating power (e.g., 120 volt 60 cycle or 220 volt 50 cycle AC) to +5 and −5 volts DC to operate the communications electronics in the communications subsystem (150 in FIG. 1). The converted power is conducted along power cable 612 to a cable adapter 620. The cable adapter 620 has two outlet cables, one shown at 616 which terminates in an industry standard termination, such as universal serial bus (USB), firewire (IEEE 1394), RS232, RJ11 (telephone jack), ISO/IEEE 802/3 (Ethernet) or any other industry standard connection compatible with a corresponding connector on the surface device (e.g., computer or recording unit). The other outlet cable is shown at 614 and includes a termination that corresponds to proprietary terminal arrangement of the connector shown at 600 in FIGS. 6A, 6B and 6C.

As used herein, the term "industry standard" is intended to mean any connector and/or cable that is made according to the specification of at least one electronics industry standards setting organization. One example of such an organization is the Institute of Electrical and Electronics Engineers (IEEE) which sets standards for the USB and IEEE 1394 connectors mentioned above. Another example of a standards setting organization is the Electronic Industries Alliance (EIA). Yet another example of a standards setting organization is the Deutsches Institut fur Normung (DIN), which sets industry standards for such electronic connectors and other devices in Germany. The foregoing are only intended as examples of organizations that define specifications for standard electrical connectors and are not intended to limit the scope of the types of connectors that may be used with the invention.

Figure 9A:
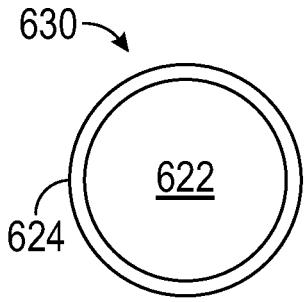
FIGS. 9A, 9B and 9C show different views of an example feedthrough communications connector according to the invention.
Figure 9B:
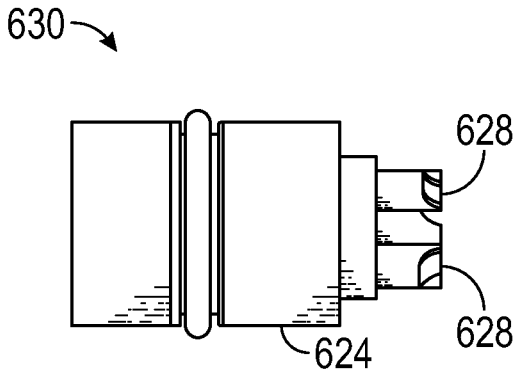
Figure 9C:
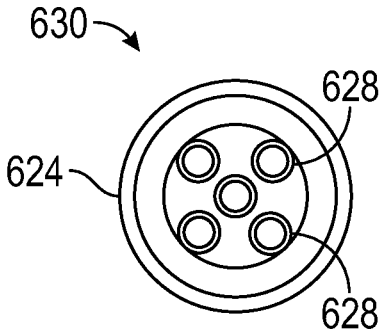
Figure 10:
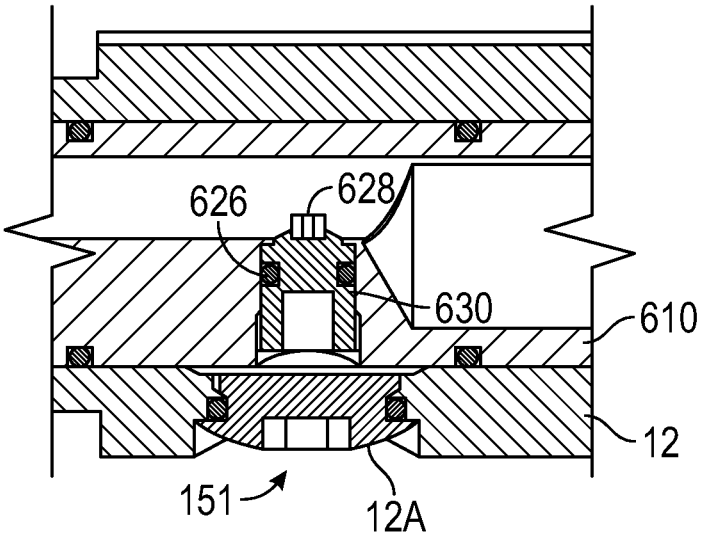
FIG. 10 shows the example feedthrough communications connector of FIGS. 9A, 9B and 9C assembled to the tool port, similar to the view in FIG. 7.
Figure 11A:
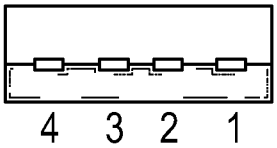
FIGS. 11A through 11F show various examples of industry standard universal serial bus (USB) connector configurations.
Figure 11B:
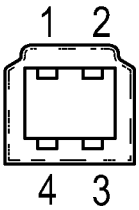
Figure 11C:
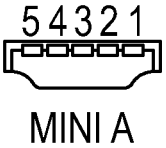
Figure 11D:
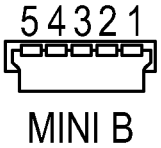
Figure 11E:
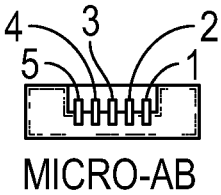
Figure 11F:
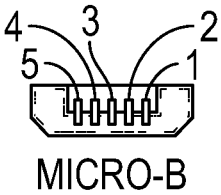

An example communication connector according to the invention is shown at 630 in FIGS. 9A, 9B and 9C. An end view in FIG. 9A shows an industry standard connector base 622 molded into a casing 624. The casing 624 may be made from any material that is essentially impermeable to moisture and is electrically non-conductive. Examples of suitable materials for the casing 624 include, without limitation, plastic, rubber, ceramic, glass and various curable resins. As shown in a side view in FIG. 9B, the casing 624 may include a suitable feature for an o-ring 626 or similar seal to sealingly engage the casing 624 with the port (FIG. 10). Contact pins 628 to make electrical connection to the circuits in the wellbore instrument (e.g., communication subsystem 150 in FIG. 1) are shown in FIG. 9B and in the opposed end view of FIG. 9C. Depending on the geometry of the connector base 622 and the geometry and composition of the casing 624, the connector 630 may also form a pressure barrier to prevent entry of wellbore fluid into the interior of the instrument in the event of seal failure of the plug (12A in FIG. 10, explained below).

The industry standard connector base 622 in FIG. 9A is intended to mate with a corresponding industry standard electrical contact plug (e.g., see FIG. 13A-13E) on a communications cable (or the male and female terminations may be respectively reversed with respect to the connector 630 and the plug. The industry standard connector base 622 may be, without limitation, any of the foregoing examples listed above, including universal serial bus (USB), firewire (IEEE 1394), RS232, RJ11 (telephone jack), ISO/IEEE 802/3 (Ethernet) or any other industry standard connection matable with a corresponding electrical connector that terminates a connector cable (see FIGS. 13A-13E).

FIG. 10 shows the connector 630 assembled to the wellbore measurement instrument in the communications port 151. The port 151 may be sealingly closed using a plug 12A.

Figure 12A:
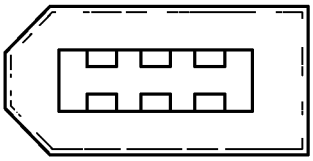
FIGS. 12A and 12B show examples of "firewire" (IEEE 1394) connector configurations.
Figure 12B:
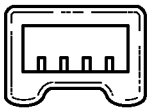
Figure 13A:
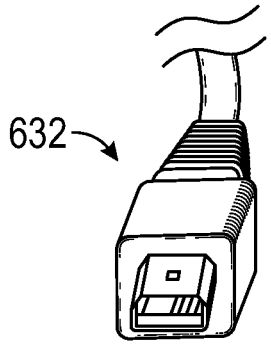
FIGS. 13A through 13E show examples of industry standard plug connectors that terminate a communications cable and may be used to connect a surface device to one of the example connectors shown in FIGS. 9A, 9B, and 9C.
Figure 13B:
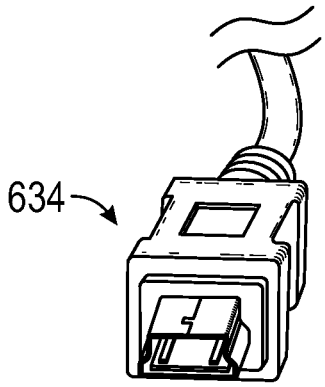
Figure 13C:
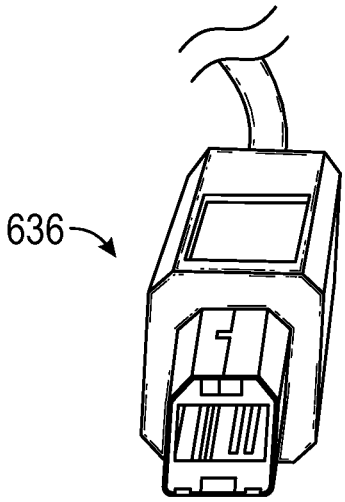
Figure 13D:
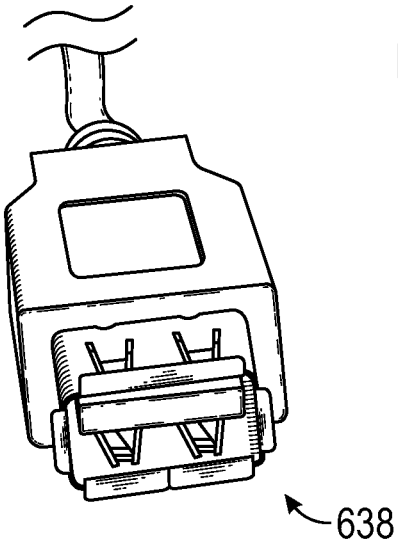
Figure 13E:
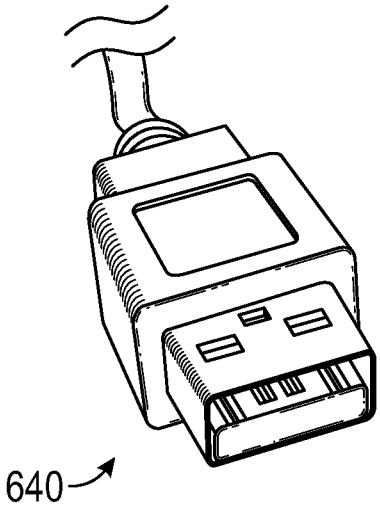

Some examples of IEEE USB connectors that may be used for the communications connector (630 in FIGS. 9A-9C) are shown in FIGS. 11A through 11F. Some examples of IEEE 1394 connectors ("firewire") that may be used for the communications connector are shown in FIGS. 12A and 12B.

To connect the surface device (e.g., computer or recording unit 45 in FIG. 1) to the communication connector (630 in FIGS. 9A-9C) it is possible to use commercially available, "off the shelf" cables pre-terminated with a connector configured to mate to the selected "off the shelf" communications connector (630 in FIGS. 9A-9C). Examples of such pre-terminated cables are shown in FIGS. 13A through 13E. At 632-640, respectively. The examples shown in the foregoing figures are for IEEE USB connectors. It should be clearly understood that any other industry standard termination corresponding to the arrangement used in the communications connector (630 in FIGS. 9A-9C) may be used with a communications cable according to the invention. The other end of the cable (e.g., as shown at 632-640 FIGS. 13A through 13E) should have a connector compatible with a receptacle or other connection on the surface device (e.g., computer or recording unit 45 in FIG. 1) used to access the data storage in the wellbore measurement instrument and/or to access the controller in the wellbore measurement instrument (e.g., the communications subsystem 150 in FIG. 1).

Communication connectors made according to various aspects of the present invention may provide lower manufacturing and maintenance costs for wellbore measurement instruments, and may reduce logistical problems associated with using proprietary configuration electrical cables to connect an instrument communication subsystem to a surface device.

It will be understood that disclosed embodiments may include a communications module suitable for use with in a wireline or slick-line logging operation. For example, the communications module may be deployed on one end (e.g., the upper end) of a string of wireline logging tools. In particular, disclosed embodiments of the communications module may be advantageously utilized in a "wireline" logging operation in which there is no electrical or electronic (wireline) connection to the surface. Such operations may be thought of as being "blind" in the sense that there is no communication between the string and the surface during the logging operation. In such embodiments the communications module includes a sufficient quantity of electronic memory (e.g., flash memory) to store the logging data acquired during the logging operation.

Figure 14:
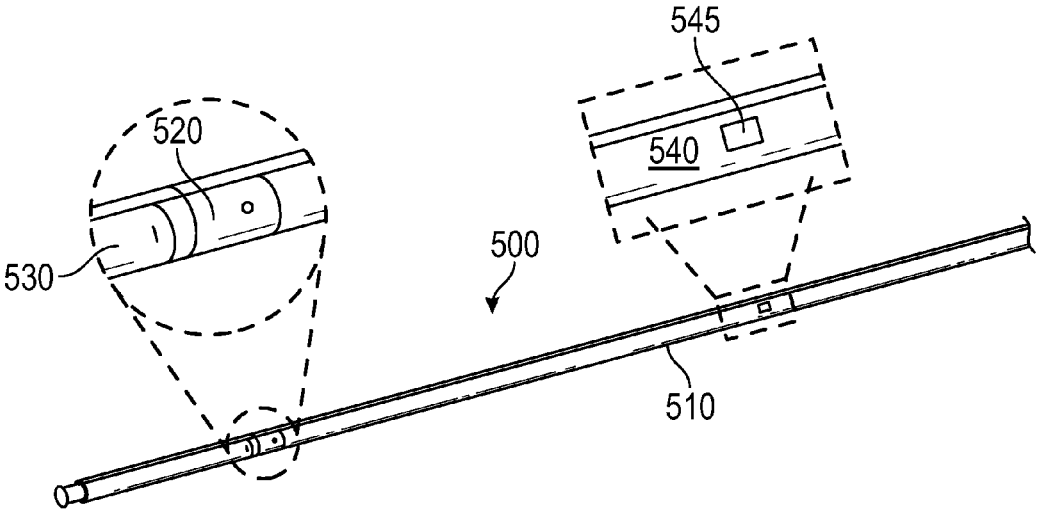
FIG. 14 depicts one disclosed embodiment of a wireline logging communications module.

FIG. 14 depicts one example of a downhole logging communications module 500. In the depicted embodiment, communications module 500 includes a tool body 510 configured to be coupled with a string of wireline logging tools. The communications module 500 further includes an optical annunciator 520 deployed in the tool body. The optical annunciator may be deployed in the tool body, for example, as described above with respect to FIGS. 2A, 2B, 3, and 4A-4D. In one embodiment, the optical annunciator includes first and second light emitting diodes (e.g., green and red light emitting diodes) and thus may also be referred to as an LED annunciator. As described in more detail below visual observation of the annunciator 520 is intended to enable an operator to determine the operating status and functionality of the communications module 500 and each of the logging tools deployed in the string.

The communications module 500 further includes an electronic communications port 530, such as a USB port, deployed in the tool body 510. The communications port 530 may be deployed in the tool body, for example, as described above with respect to FIG. 10. The communications port 530 may be advantageously configured for coupling with a portable electronic device such as a lap top computer, a tablet computer, or a smart phone and therefore preferably includes a universal serial bus (USB) port.

As described above, communications module 500 may be configured for deployment in a string of wireline logging tools, e.g., including resistivity logging tools, nuclear logging tools, acoustic logging tools, and the like. In one embodiment, the communication module is deployed axially between a string of wireline logging tools and a battery pack configured to provide electrical power to the module 500 and the string of logging tools. In such an embodiment, there is no electrical or electronic connection between the string of logging tools and the surface. In other words, there is no "wireline" for providing electrical power from the surface and electronic communication with the surface.

As stated above, the LED annunciator is configured to provide a visual indication of the operating status and functionality of the communications module and the string of logging tools. In one embodiment, this visual indication is given by a series of optical (light) pulses. For example both the red and the green LEDs may be lit (providing a yellow/orange light) to indicate the beginning of a series of optical pulses. A series of pulses may then be used to indicate the status of the communications module and the logging tools in the string. A green pulse may be used to indicate that the corresponding tool is operational and ready for deployment. A red pulse may be used to indicate that the corresponding logging tool is not ready. In this way, the red pulse thereby alerts the operator that a particular tool is nonfunctional or otherwise not ready for deployment in the wellbore.

With continued reference to FIG. 14, it will be understood that communications module 500 includes an electronic controller 540 (shown schematically), for example, including one or more circuit boards including a microprocessor, electronic memory (such as FLASH memory), and other circuitry configured for communicating with and/or controlling the functionality of the various logging tools. The controller also preferably further includes a power management circuit 545. In one embodiment, the power management circuit is configured to manage electrical power supplied by the battery pack and electrical power supplied via the USB port (e.g., from a lap top computer). When battery power is present (via the battery pack) circuit 545 enables the entire string to be powered. In the absence of a battery pack, circuit 545 enables the electronic controller (or a portion thereof such as the memory) to be powered via the USB port. The remainder of the string cannot receive power from the USB port (in the absence of a battery pack or other external power source).

Figure 15:
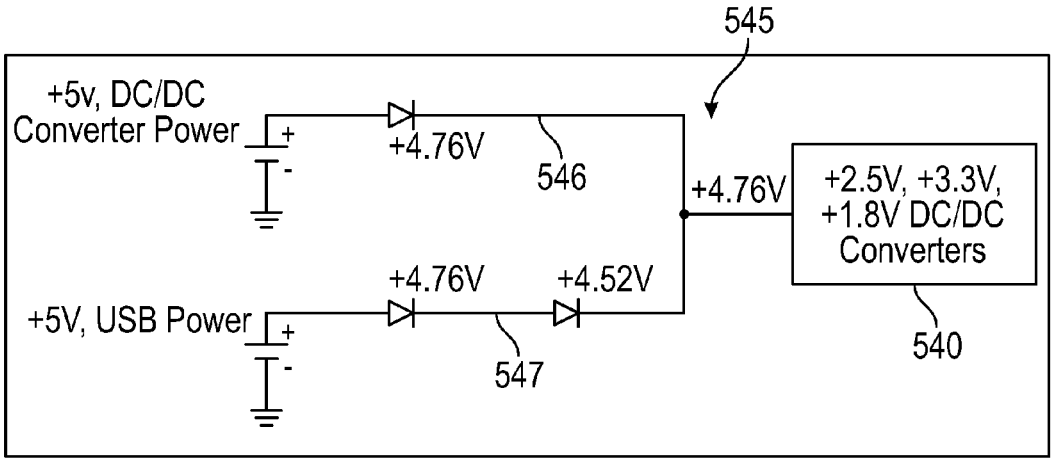
FIG. 15 depicts one embodiment of a suitable power management circuit for use in the communications module shown on FIG. 14.

FIG. 15 depicts one embodiment of a suitable power management circuit 545. In the depicted embodiment the power management circuit includes first and second parallel power input lines 546 and 547. Battery power (from the battery pack) may be provided via the first input line and USB power via the second input line. In the depicted embodiment, battery power may be routed through a single diode to the electronic controller 540. USB power is routed through first and second serial diodes to the controller. Note that each diode steps down the received voltage by about 0.24 volts such that the USB voltage is stepped down further than the battery power. The depicted power management circuit 545 enables the memory and other selected components in the electronic controller 540 to be powered by the USB power (i.e., by the electronic device connected to the tool via the USB port). The depicted circuit 545 further enables the entire string (including the electronic controller 540) to be powered by a battery pack when present. Furthermore, the first and second serial diodes prevent any device connected to USB port from being damaged by power from the battery pack.

Use of the above described power management circuit 545 advantageously enables controller memory to be accessed in the absence of an external power supply (such as a battery pack). For example, an electronic device such as a lap top computer may be connected to the communications module 500 via the USB port 530. The lap top may thus provide electrical power to the communications module memory thereby enabling the tool memory to be retrieved and/or enabling instructions to be loaded to the memory.

Figure 16:
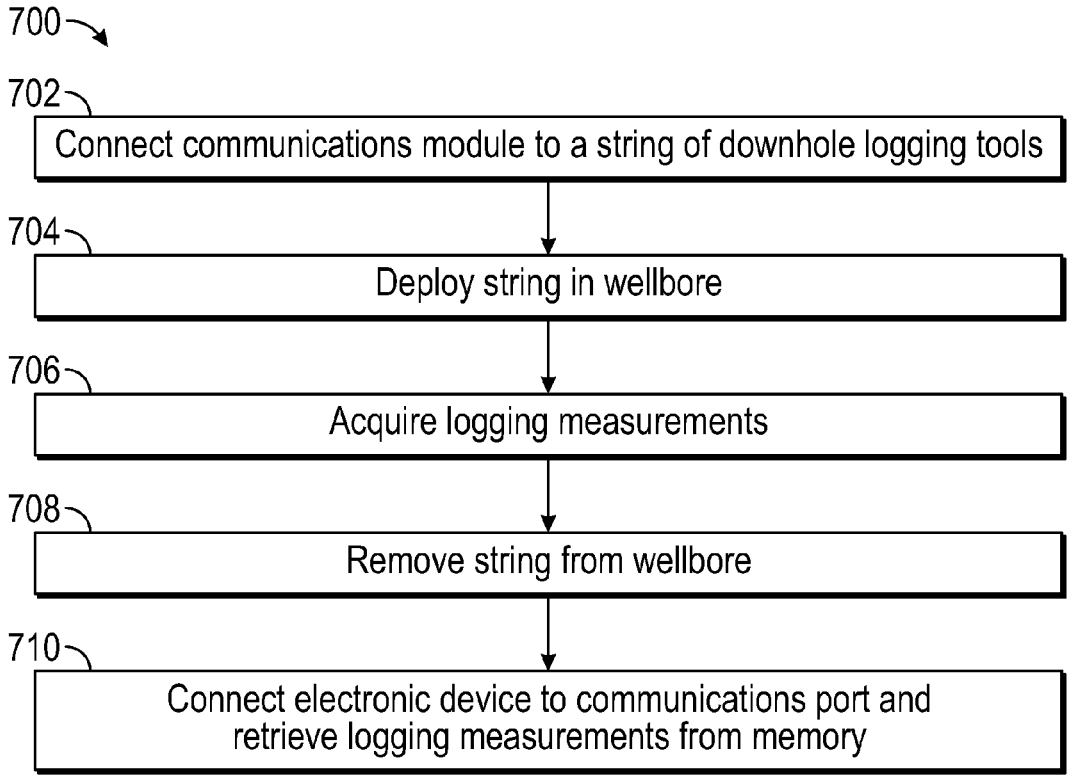
FIG. 16 depicts one exemplary method embodiment for logging a subterranean wellbore using the communications module shown on FIG. 14.

FIG. 16 depicts one exemplary method embodiment 700 for logging a subterranean wellbore. The communications module may be connected to a string of downhole logging tools at 702 and the string deployed in the wellbore at 704. After acquiring obtaining logging measurements at 706, the string may be retrieved from the wellbore at 708. An electronic device may be connected to the communications port and the logging data retrieved from memory at 710. The method may further include connecting the electronic device to the communications port prior to deploying the string in the wellbore and uploading instructions or system firmware to communications module memory from the electronic device. The method may still further include observing the LED annunciator to ensure that each of the logging tools in the string is fully functional prior to deploying the string in the wellbore.

Figure 17A:
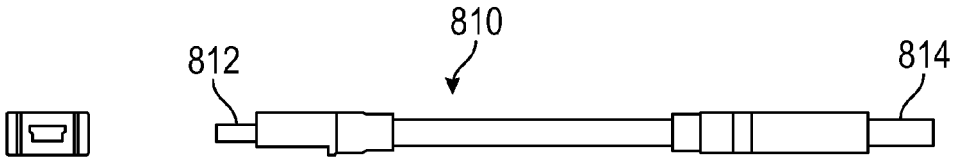
FIG. 17A depicts a conventional USB cable including conventional connectors.
Figure 17B:
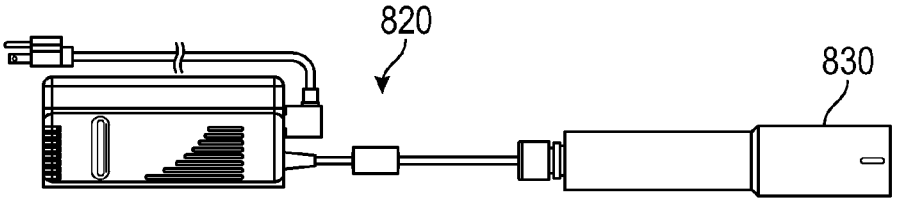
FIG. 17B depicts an AC to DC converter including a customized connector for connecting with and providing electrical power to the communications module.

FIGS. 17A and 17B depict connectors that may be used with the communications module 500. FIG. 17A depicts a conventional USB cable 810 including conventional connectors 812 and 814. In embodiments in which the communications port 530 includes a USB port, connector 812 may be connected with the communications port and connector 814 with the portable electronic device (e.g., the laptop computer). FIG. 17B depicts an AC to DC converter 820 including a customized connector 830 for connecting with and providing electrical power to the communications module 500. Converter 820 and with connector 830 enables full power to be provided to the communications module 500 in the absence of a battery pack. Such an arrangement advantageously allows for surface testing of the string while preserving battery power for downhole deployment.

Although a downhole logging communications module and method for using the module have been described in detail, it should be understood that various changes, substitutions and alternations can be made herein without departing from the spirit and scope of the disclosure as defined by the appended claims.

What is claimed is:

1. A downhole communications module for connecting with a string of downhole logging tools, the communications module comprising:

a downhole tool body configured to be connected with a string of wireline logging tools;

an optical annunciator deployed in a first aperture in the tool body, the first aperture sealed by a port plug having an optically transparent window therein, the port plug configured to resist entry of wellbore fluid into an interior of the tool body;

a communications port including an electrical connector disposed in a second aperture in the tool body, the second aperture further including a removable plug for sealing the communications port and resisting entry of wellbore fluid into the interior of the tool body;

a controller deployed in the tool body, the controller including a memory module in electronic communication with the communications port, the controller further configured to control operation of the annunciator.

2. The communications module of claim 1, wherein the tool body is further configured to be deployed axially between the string of wireline tools and a battery pack.

3. The communications module of claim 1, wherein the controller further comprises a power management circuit configured to manage electrical power supplied by a battery pack and electrical power supplied via the communications port such that (i) when battery power is present the power management circuit connects battery power to the controller as well as the string of logging tools and (ii) is in the absence battery power the power management circuit disconnects the string of logging tools from electrical power and connects at least a portion of the controller with electrical power provided through the communications port.

4. The communications module of claim 3, wherein the power management circuit comprises first and second parallel power input lines, the first input line configured for receiving battery power and including a single diode, the second input line electrically connected with the communications port and including first and second diodes connected in series.

5. The communications module of claim 1, wherein the optical annunciator includes first and second light emitting diodes configured to emit corresponding first and second distinct colors.

6. The communications module of claim 1, wherein the controller is configured to cause the optical annunciator to provide a visual indication of the operating status and functionality of the string of logging tools.

7. The communications module of claim 1, wherein the visual indication is provided by a series of visible optical pulses.

8. The communications module of claim 1, wherein the communications port comprises a universal serial bus (USB) connector.

9. A method for logging a subterranean wellbore, the method comprising:

(a) deploying a communications module in a tool string with a battery pack and a plurality of downhole logging tools, the communications module including (i) a downhole tool body, (ii) an optical annunciator deployed in a first aperture in the tool body, the first aperture sealed by a port plug having an optically transparent window therein, the port plug configured to resist entry of wellbore fluid into an interior of the tool body, (iii) a communications port including an electrical connector disposed in a second aperture in the tool body, the second aperture further including a removable plug for sealing the communications port and resisting entry of wellbore fluid into the interior of the tool body, and (iv) a controller deployed in the tool body, the controller including a memory module in electronic communication with the communications port, the controller further configured to control operation of the annunciator;

(b) deploying the tool string in the wellbore;

(c) causing the logging tools in the tool string to acquire logging measurements;

(d) removing the tool string from the wellbore;

(e) connecting a portable electronic device with the communications port; and (f) retrieving the logging measurements acquired in (c) via the connection established in (e).

10. The method of claim 9, wherein the controller causes the optical annunciator to generator an visual optical signal indicative of an operating status of each of the logging tools in the tool string upon the deployment in (a).

11. The method of claim 10, further comprising observing the optical signal prior to deploying the tool string in the wellbore in (b).

12. The method of claim 9, further comprising the following steps prior to deployment of the tool string in the wellbore in (b):

(b1) connecting the portable electronic device with the communications port;

(b2) uploading instructions to the controller;

(b3) disconnecting the portable electronic device from the communications port; and (b4) securing a plug in place over the communications port to prevent ingress of drilling fluids.

13. The method of claim 9, wherein (d) further comprises disconnecting the battery pack from the tool string such that the portable electronic device provides electrical power to the controller during (e) and (f).

* * * * *